US005254220A

United States Patent [19]

de la Cierva et al.

[11] Patent Number: 5,254,220

[45] Date of Patent: Oct. 19, 1993

[54] PROCESS FOR POSITIONING RIGID SEGMENTS INTO A CONTINUOUS PAPER WEB

[75] Inventors: Juan de la Cierva; Jesus C. Prieto, both of Madrid, Spain

[73] Assignee: Fabrica Nacional de Moneda y Timbre, Madrid, Spain

[21] Appl. No.: 907,071

[22] Filed: Jul. 1, 1992

[51] Int. Cl.[5] ..... D21H 21/52

[52] U.S. Cl. ..... 162/108; 162/140

[58] Field of Search ..... 162/103, 105, 106, 108, 162/140

[56] References Cited

U.S. PATENT DOCUMENTS

| | | | |
|---|---|---|---|
| 5,020,581 | 6/1991 | Gutierrez | 162/103 |
| 5,055,160 | 10/1991 | Gutierrez | 162/103 |
| 5,099,224 | 3/1992 | Santiago et al. | 340/551 |

*Primary Examiner*—Peter Chin

*Attorney, Agent, or Firm*—Jesus Sanchelima

[57] ABSTRACT

A process for positioning rigid segments into a paper web being formed through a hybrid band and the resulting article of manufacture from this process. The positioning of the rigid segments with uniform predetermined separation between them and their uniform length provide a wavelength for the hybrid band with the consequent advantage for readily detecting its electromagnetic characteristics. The paper web is divided in continuous adjacent sheets that include each one matrix and surrounding margin areas. The web has one or more sheets across. The matrix includes a set of document areas therein that correspond to the resulting bank notes, or document areas, in the preferred application for this invention. Each resulting document area includes one or more rigid segments that is, or are, symmetrically positioned with respect to a longitudinal and central axis across said document areas. The height of the document area is a multiple of the hybrid band wavelength and the multiple is also equal to the number of rigid segments per document area.

6 Claims, 2 Drawing Sheets

PROCESS FOR POSITIONING RIGID SEGMENTS INTO A CONTINUOUS PAPER WEB

BACKGROUND OF THE INVENTION

1. Field of the Invention

The present invention relates to a process that allows the insertion of rigid segments into a security paper web being formed with predetermined positioning of said rigid segments relative to the resulting documents which will be obtained from said paper web while maintaining certain dimensions (end of segment to edge of document and separation between segments) constant even if document sizes are different.

2. Description of the Related Art

Applicant believes that the closest reference corresponds to U.S. Pat. Nos. 5,055,160 and 5,020,581 wherein a process is described to make security paper with rigid segments and the process for manufacturing the hybrid band that houses the rigid segments. As described in said patents, the hybrid band is composed of rigid segments which are covered by a stretchable polyester base that allow it to stretch during the paper's drying process. Said patents document the need to precisely align the rigid segments for subsequent printing and cutting operations.

The precise positioning of rigid segments within the resulting security documents enhance their security or anticounterfeiting characteristics. Precisely fixing the separations between rigid segments, the distance from the end of a rigid segment to the edge of the document and the increments in segment lengths from different members within a family (of differently sized) documents will directly affect the quality of the resulting security paper. In particular, these characteristics will be readily displayed by the resulting documents' electromagnetic characteristics (or signatures) as they would be utilized with these applicants' Method for Identifying Magnetic Characteristics of Magnetic Elements, U.S. Pat. No. 5,099,224 issued on Mar. 24, 1992. None of said patents, nor any other reference in the prior art, suggest the use of a process to precisely position rigid segments to facilitate the reading of their characteristics.

Finally, visual and tactile authentication, as well as electronic, magnetic electro-magnetic or optical detection, are greatly enhanced by having uniform distances from the ends of segments to the edges of the documents. Also, the distances between segments are uniform even if the size of the segment is varied for documents of different sizes.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a process for the precise insertion of rigid segments in a paper web being formed so that the segments are always inserted in the same position within the resulting documents.

It is another object of this invention to provide such a process wherein the resulting documents could be of different size.

It is still another object of this invention to provide a process wherein the resulting documents define matrices of different dimensions and/or configurations.

It is another object of this invention to provide a process that includes the spacing of sheets on the paper forming mesh by which the resulting sheets of security paper (defined by a matrix of documents plus margins) are produced on the paper forming mesh so that the rigid segments can be positioned (or phased) during their insertion into the paper in a way that said rigid segments are positioned uniformly on all documents of every sheet.

It is still another object of this present invention to provide a process for the insertion of rigid segments in a web of paper being formed so that the distance from the edge of the document to the closest end of a rigid segment is uniform on both edges of the document and on all the documents within a family of documents even if having documents of different sizes.

It is still another object of this invention to produce a process for inserting rigid segments to a paper web being formed to obtain the same spacing between segments on all documents regardless of the size of the documents. This can be achieved in spite of variations in segment length and document size among the different members of the family of documents.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
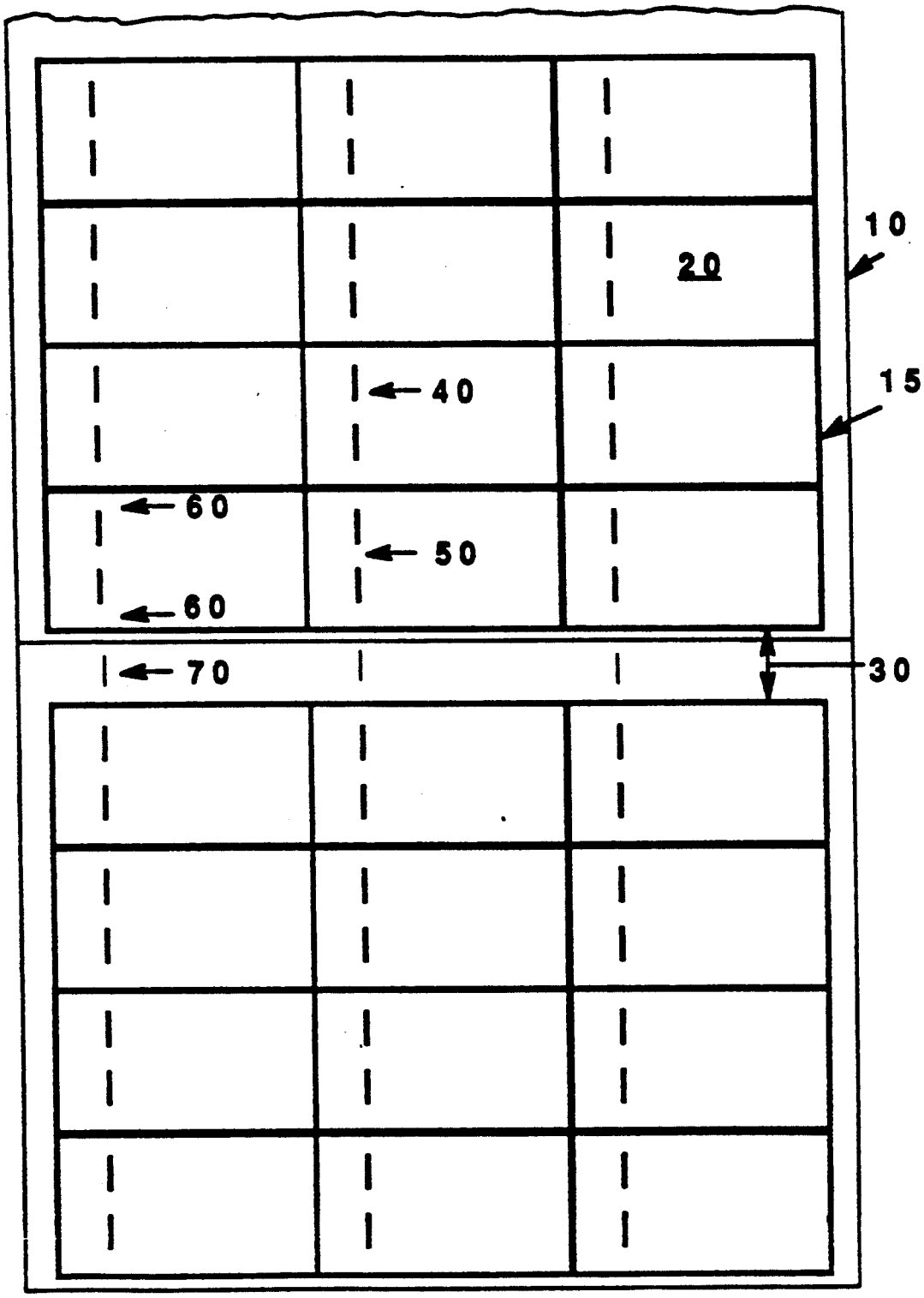
FIG. 1 represents the security paper web, showing two sheets, obtained from the paper forming machine in a continuous fashion.

Referring now to the drawings, in FIG. 1, sheets 10 include a matrix 15, which in turn includes a group or matrix of document areas 20. The dimensions of sheets 10 are established by the limitations imposed by the paper manufacturing process as well as the subsequent printing and cutting operations. In this manner, once a size is determined for a specific document 20, sheets 10 are designed accommodating the maximum number of document areas 20 within the above mentioned limitations in order to obtain the maximum efficiency for the different production, printing and cutting procedures.

The paper web can be obtained in various widths including one or more columns of identical sheets 10. Only one column of sheets 10 is shown in FIG. 1 for the sake of clarity. In FIG. 1, the continuous paper web is formed by sheets (10) composed of a matrix 15 of document areas 20. Spacing 30 between contiguous sheets 10 is designed to allow the proper positioning of rigid segments 40 which are spaced on the document area 20 by a distance 50 so that the distance from both outer end of the segments to the edge of the document is referred to as 60. Segment 70 falls in space 30 between matrices 15. Segment 70 is not used.

The number of segments 40 per document is shown in FIG. 1 to be two per document in the preferred embodiment but more or less segments can be used. The case illustrated in FIG. 1 with two segments per document is only a particular solution in which no segments are present in the center of the document so that it can be folded on the center without bending or affecting the segments and which provides the maximum distance from the outer end of the segment to the edge of the document as well as the maximum distance from the document center line to the ends of the segments. It is desirable to keep the outer end of segments 40 as far away from the edge of document area 20 as possible to prevent segments 40 from protruding through the edge of document area 20.

If "S" is the number of segments per document, and "d" is the height of a document, and if "Z" is the space 30 between matrices 15 on the paper obtained from the paper forming machine, then:

$$\text{space } 30 = Z = N\frac{d}{S}$$

Where N is a positive, non zero integer. In the preferred embodiment N=1 in order to keep the space between matrices 15 at a minimum as this paper is not used. Additionally, in the preferred embodiment S=2 in order to obtain maximum distance from the segment outer end to the document's edge and to the center line of document area 20 as previously indicated. In this manner, "Z" will be a multiple of the wavelength of the hybrid band that includes segments 40. The wavelength is defined as the distance from the outer end of a segment to the inner end of a contiguous segment within the same document area 20 i.e., the length of the segment plus the space separating the segment form an adjacent segment.

If "R" is the number of Rows of documents per sheet 10, then "N" out of every N+(R*S) segments will fall in space 30 and the insertion process will repeat itself or be periodic every N+(R*S) number of wavelengths of the hybrid band. Expressed in other words, space 30 must be a non zero multiple of the hybrid band's wavelength "w" which is equal to the sum of segment length "y" and segment separation on dry paper "x".

Figure 2:
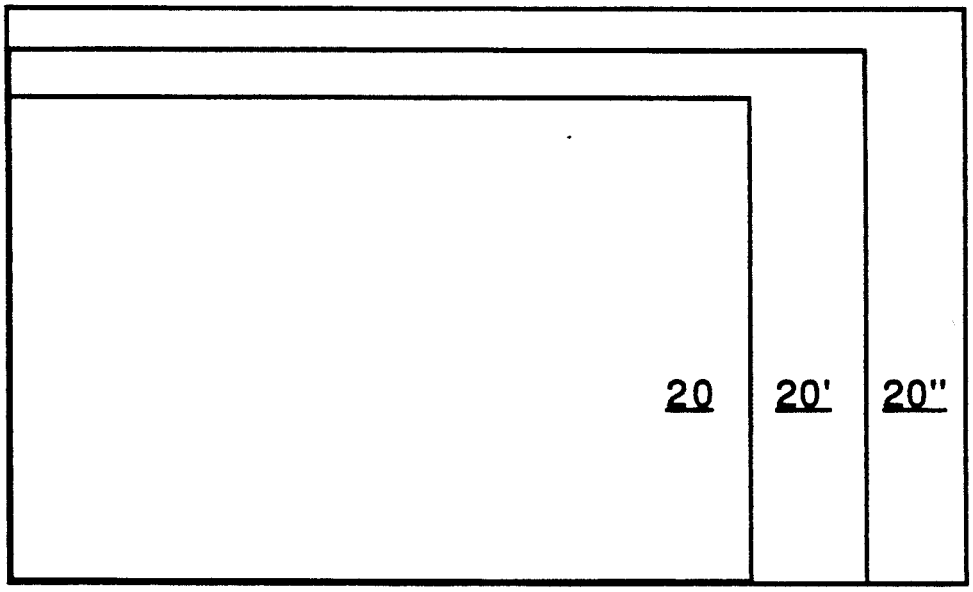
FIG. 2 represents a family of superimposed documents, after being cut off from the matrix in a paper web, illustrating the different dimensions of each document.

A family of documents includes document areas 20 of different denominations and each type of document may have different dimensions, as shown in FIG. 2. Typically, they correspond to bank notes (bills) of different denominations. In such a case, size increments on both central axes (length and width) usually follow a pre-established rule and the most commonly used criteria involves adding a fixed amount to each successive size of document although these amounts may be different on the length and width axes. In this manner, if the smallest document is "L" long and "H" high, length increments would be set as "λ" and height increments would be set as "h" resulting in documents sized as follows:

| | Length | | Height |
|---|---|---|---|
| Document 1 = | L | by | H |
| Document 2 = | L + λ | by | H + h |
| Document 3 = | L + 2λ | by | H + 2h |
| Document 4 = | L + 3λ | by | H + 3h |
| or in general: | | | |

-continued

| | Length | | Height |
|---|---|---|---|
| $\text{Document}_i$ = | L + (i − 1)λ | by | H + (i − 1)h |

where i goes from 1 to the number of documents in a family.

In a similar fashion, segment length "y" would be established for the smallest document and other larger segment lengths would be calculated for the other document members of the family as follows:

$$\text{Segment1} = Y1$$

$$\text{Segment2} = Y1 + \frac{h}{S} = y2$$

$$\text{Segment3} = Y1 + \frac{2h}{S} = y3$$

$$\text{Segment4} = Y1 + \frac{3h}{S} = y4$$

or in general:

$$\text{Segment}i = Y1 + \frac{(i-1)h}{S} = yi$$

This results in hybrid band designs in which the increments in document sized "d" are accomplished by increments in segment length "y" such that segment separation on paper "x" remains constant. This in turn produces a constant distance 60 from the outer end of the segments to the edge of the docment at both the top and bottom edges of said document. Also, the distance between the inner ends of segments 40 and the longitudinal center line of document area 20 is the same.

It is important to note that the hybrid bands produced for the different sizes of documents within a family will have different lengths of segments as well as different spacing between segments although segment spacing on paper will be identical. This is due to the stretching of paper during the drying process which is in order of 1%-2% as indicated in the paper process patents. This stretching affects documents with different heights in such a way that the spacing between segments upon insertion must be different in order to achieve the same spacing on dry paper after the insertion and drying process.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A process for positioning rigid segments with magnetic properties into a paper web being formed comprising the steps of:

A. cutting segments from a continuous rigid wire member thereby forming said rigid segments having two ends;

B. positioning said rigid segments on a continuous strip of a stretchable adhesive carrier means with a predetermined uniform space between said rigid segments thereby forming a continuous hybrid band; and C. feeding said hybrid band into said paper web being formed in a manufacturing process wherein said paper web includes at least one sheet across the width of said paper web and said sheet including one matrix area and a peripheral margin around said matrix area, and said matrix area further including a plurality of contiguously disposed document areas having each a peripheral edge and a predetermined document area height, and the wavelength of said band is equal to the length of the segment plus the space separating the segment from an adjacent segment and wherein the space between contiguous matrices is a multiple of the wavelength of said hybrid band and wherein said number of rigid segments is at least two which are positioned within each one of said document areas so that the ends of said rigid segments are uniformly positioned at a predetermined distance from said peripheral edge.

2. The process set forth in claim 1 wherein said rigid segment, or segments, is, or are, positioned into each one of said document areas symmetrically with respect to the document areas' centerline which is perpendicular to the longitudinal axis of said paper web.

3. The process set forth in claim 2 wherein the spacing between contiguous rigid segments is maintained constant even for document areas of different heights.

4. The articles of manufacture resulting from the process set forth in claim 1.

5. The articles of manufacture resulting from the process set forth in claim 2.

6. The articles of manufacture resulting from the process set forth in claim 3.

* * * * *